US005476159A

United States Patent [19]

Cho

[11] Patent Number: 5,476,159

[45] Date of Patent: Dec. 19, 1995

[54] LINEAR MOTOR SUPPORTING APPARATUS FOR LINEAR MOTOR ELEVATOR

[75] Inventor: Kil H. Cho, Kyungsangnam-Do, Rep. of Korea

[73] Assignee: LG Industrial Systems Co., Ltd., Seoul, Rep. of Korea

[21] Appl. No.: 283,752

[22] Filed: Aug. 1, 1994

[30] Foreign Application Priority Data

Aug. 6, 1993 [KR] Rep. of Korea ..... 15050/1993

[51] Int. Cl.[6] ..... B66B 1/06

[52] U.S. Cl. ..... 187/289; 187/404; 187/406; 187/414

[58] Field of Search ..... 187/404, 405, 187/406, 411, 412, 414, 289, 292

[56] References Cited

U.S. PATENT DOCUMENTS 4,402,386 9/1983 Ficheux et al. ..... 187/289

5,062,501 11/1991 Pavoz et al. ..... 187/289

FOREIGN PATENT DOCUMENTS 372576 6/1990 European Pat. Off. ..... 187/289 X 5147860 6/1993 Japan ..... 187/289 X

*Primary Examiner*—William E. Terrell

*Assistant Examiner*—Dean A. Reichard

*Attorney, Agent, or Firm*—Oliff & Berridge

[57] ABSTRACT

A linear motor supporting apparatus for a linear motor elevator capable of greatly dampening a load from a stator when a relative displacement of the stator and guide rails occur, includes a linear motor including a rotor and a stator; a tensile force adjusting device, disposed below the stator, for adjusting a tensile force upon the stator; and a stator displacement adjusting device, disposed between the tensile force adjusting device and a supporting frame, for greatly reducing a load upon the stator by moving the stator by as much as a relative displacement between the stator and the rotor.

5 Claims, 4 Drawing Sheets

LINEAR MOTOR SUPPORTING APPARATUS FOR LINEAR MOTOR ELEVATOR

BACKGROUND OF THE INVENTION

1. Field of the Invention

The present invention relates to a linear motor supporting apparatus for a linear motor elevator, and more particularly to an apparatus for dampening a load from a stator of a linear motor, which varies according to the relative displacement between the stator and guide rail.

2. Description of the Conventional Art

Conventionally, a cable type elevator requires a more spacious machinery room for developing the driving force. However, in order to overcome such problems, the elevator adopting the linear motor attracts wide attentions due to its vibration- and noise-abatement features and even smaller space requirements for installation of the driving machinery.

Referring to FIGS. 1 and 2, there is shown an elevator equipped with a linear motor. In the figure, the passenger car is connected with cable 6 for controlling the ascent and descent thereof.

The other ends of the cable 6 are connected to a square frame member 4 in which is disposed a rotor 2, having a bore hole for slidably receiving a stator 1 and linearly going up and down along the stator 1, for driving the car 5 is disposed. Here, one end of the stator 1 is rigidly affixed to an upper supporting bar of the elevator main frame 8 and the other end thereof is connected to a supporting apparatus 50 of the lower supporting bar of the elevator main frame 8. Both sides of the square frame member 4 mounting the rotor 2 are slidably in contact with a pair of parallel guide rails 7 mating with the both sides thereof, which are spaced apart from each other and by a predetermined distance from the stator 1, respectively. Therefore, the rotor 2 moves slidably linearly up and down along the stator 1 with a guide of the guide rail 7.

There is formed an air gap between the outer surface of the stator 1 and the inner surface of the bore hole of the rotor 2 for maintaining a predetermined distance therebetween, and on the rotor 2 are disposed a plurality of air gap adjusting rollers 3 for maintaining a predetermined gap therebetween. Here, the air gap adjusting rollers 3 slide along the circumferencial surface of the stator 1.

Therefore, in operation of the linear motor the rotor 2 slides linearly up and down along the stator 1 and the square frame member 4 mounting the rotor 2 slides linearly along the guide rails 7, whereby the car 5 goes up and down according to the movement of the square frame member 4.

The supporting apparatus 50, which is for substantially reducing the vibration load from the stator 1 in operation of the elevator, as shown in FIG. 2 includes a turn buckle 12 connected to the lower end of the stator 1 and a coil spring 11 whose one end is connected to the turn buckle 12 and whose other end is connected to the elevator main frame 8. The supporting apparatus 50 is described in detail with a reference to FIG. 3.

The lower end of the stator 1 of the linear motor is connected to the upper portion of a yoke 14 by a pin 14'. The lower portion of the yoke 14 rotatably receives an upper ring of a ball joint 13. A circular ring 9 integrally formed with the ball joint 13 is connected with an upper hook ring 16 of the hollow cylindrical turn buckle 12. A lower hook ring 16' of the turn buckle 12 is connected with an upper end of the coil spring 11 having a predetermined elastic property. The lower end of the coil spring 11 is connected with a ring 10 connected to the elevator main frame 8.

The turn buckle 12 and the coil spring 11 are designed for controlling the tensile force upon the stator 1, which is caused according to the movement of the rotor 2 in operation of the elevator. The stator 1 receives the vibration and impact thereof because when the stator 1 and the elevator main frame 8 are rotatably freely connected with each other, as here, when the stator 1 is forcibly vibrated, then the vibration load is dampened by the coil spring 11 of the supporting apparatus 50.

However, when the rotor 2 linearly correctly moves along the stator 1 in a vertical direction, as explained above, the conventional supporting apparatus 50 effectively works to dampen the vibration load and impact therefrom. On the contrary, when the rotor 2 and the stator 1 does not move up and down in a vertical direction correctly, the supporting apparatus 50 cannot substantially dampen the vibrations and impacts therefrom and thus the safe operation of the elevator cannot be secured. Designing the stator 1 and the rotor 2 to be correctly coincident in a vertical direction is in fact originally difficult. In this case the relative displacement between the stator 1 and the rotor 2 are directed to the load of the air gap adjusting rollers 3 disposed both at lower and upper portions of the rotor 2, thereby causing one-sided abrasion thereof and thus the safety operation of the elevator cannot be secured.

SUMMARY OF THE INVENTION

Accordingly, an object of the present invention is to provide a linear motor supporting apparatus capable of greatly reducing vibration load and impacts from a stator of a linear motor elevator while compensating for a relative displacement caused when the stator and rotor are not coincident with each other in a vertical direction.

To achieve the object, the present invention includes a linear motor including a rotor and a stator; a tensile force adjusting device, disposed below the stator, for adjusting a tensile force from the stator; and a stator displacement adjusting device, disposed between the tensile force adjusting device and a supporting frame, for greatly reducing a load from the stator by moving the stator by as much as a relative displacement between the stator and the rotor.

BRIEF DESCRIPTION OF THE DRAWINGS

The objects and features of the invention may be more readily understood with reference to the following detailed description of an illustrative embodiment of the invention, taken together with the accompanying drawings in which.

DETAILED DESCRIPTION OF THE INVENTION

Figure 2:
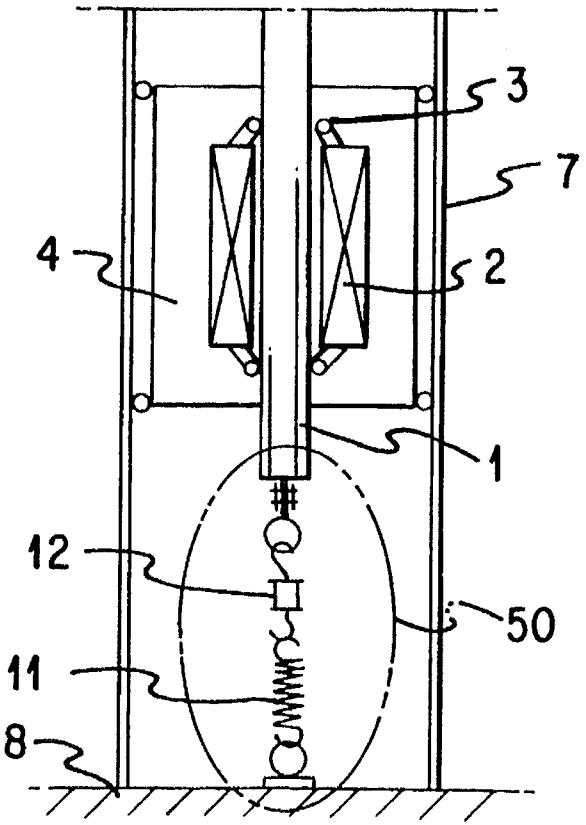
FIG. 2 CONVENTIONAL ART
FIG. 2 is a schematic structural view showing a conventional linear motor elevator supporting apparatus.
Figure 1:
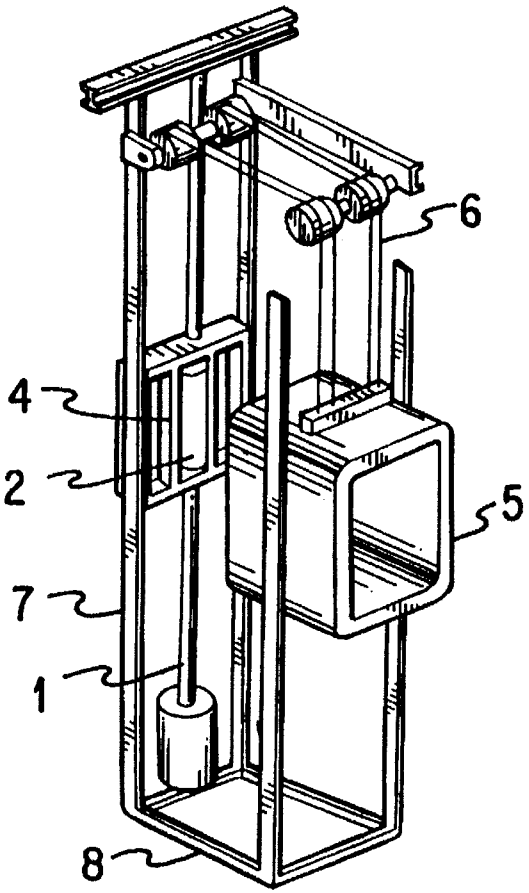
FIG. 1 CONVENTIONAL ART
FIG. 1 is a perspective view showing a conventional linear motor elevator.
Figure 3:
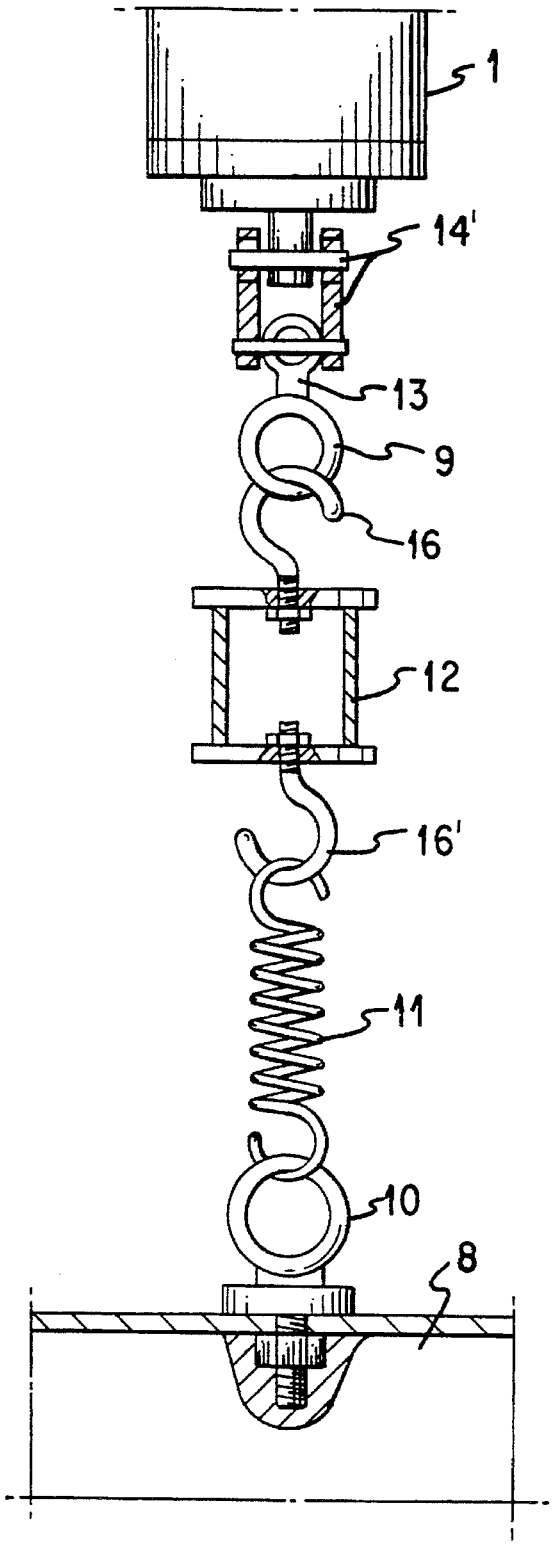
FIG. 3 CONVENTIONAL ART
FIG. 3 is a detailed partial view showing a supporting apparatus of a conventional linear motor elevator.
Figure 4:
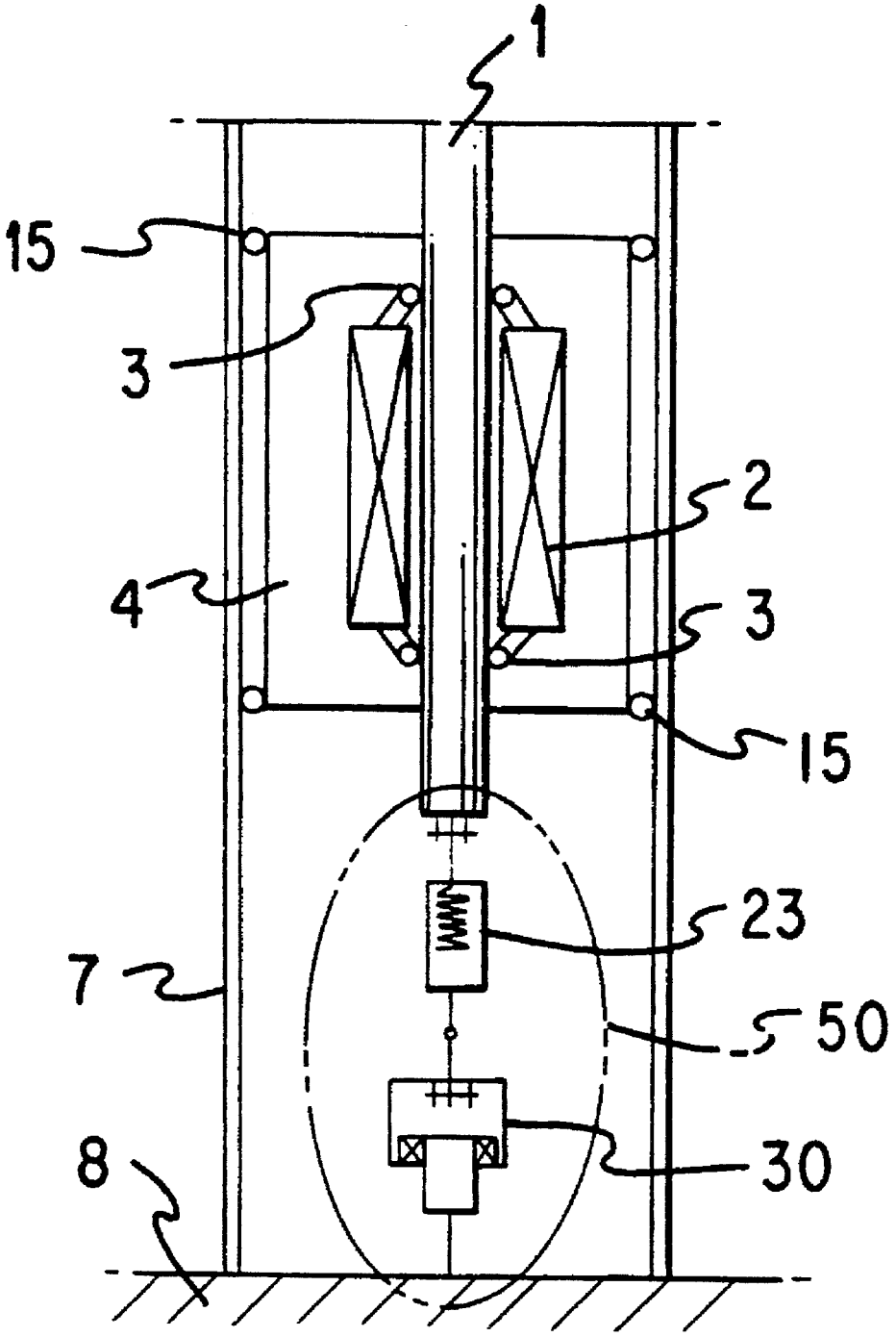
FIG. 4 is a schematic structural view showing a linear motor elevator supporting apparatus according to the present invention.
Figure 5:
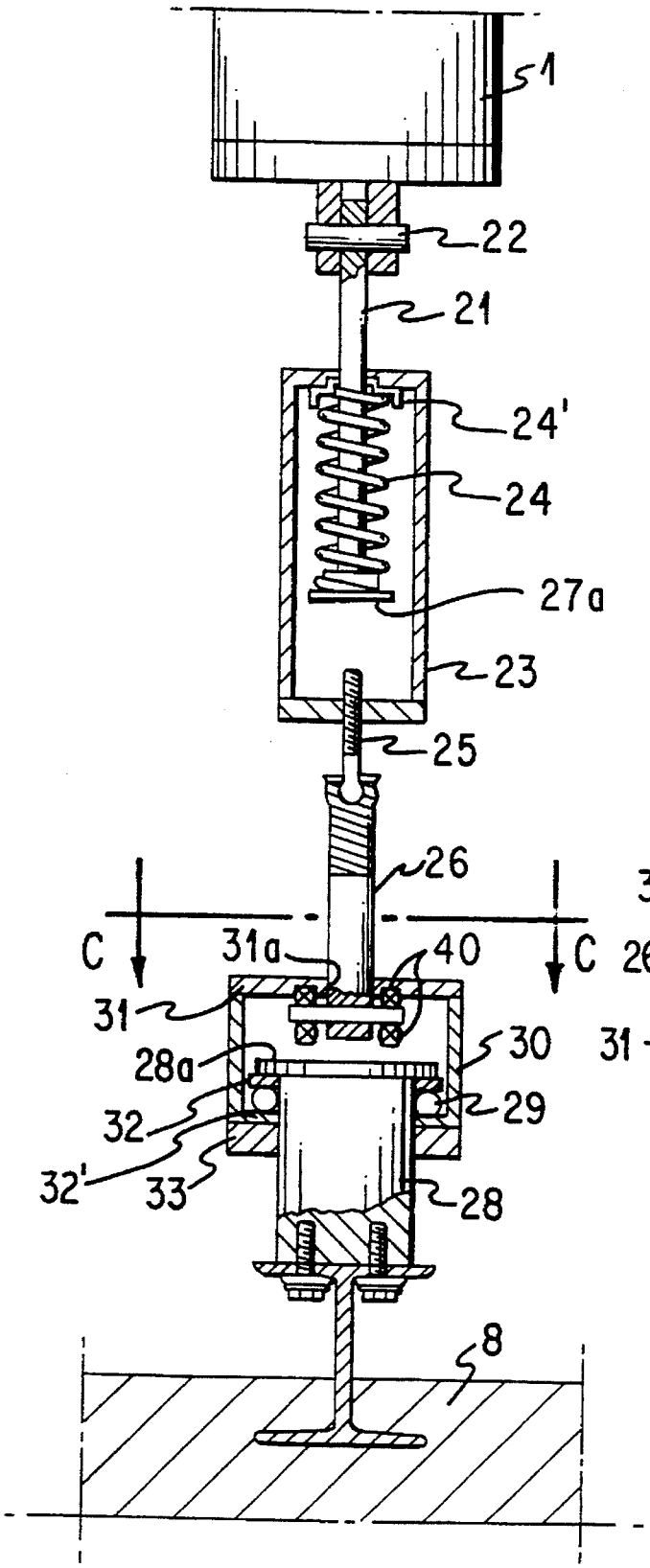
FIG. 5 is a detailed partial view showing the linear motor elevator supporting apparatus according to the present invention.
Figure 6:
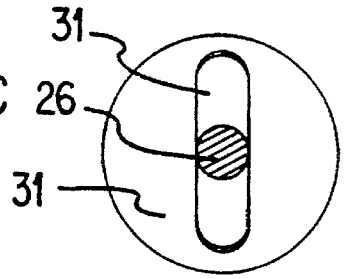
FIG. 6 is a cross-sectional view taken along line C—C of FIG. 5.

Referring to FIG. 4, there is shown schematically an elevator equipped with a linear motor supporting apparatus 50 according to the present invention, and in FIG. 5, there is shown in detail the linear motor supporting apparatus 50 from FIG. 4, and in addition, FIG. 6 shows a cross-sectional view taken along line C—C of FIG. 6.

First, an upper end of a stator 1, as shown in FIG. 4, is rigidly connected to an upper supporting frame (not shown) of the elevator, and a lower end thereof is rotatably and elastically connected with an upper end of a linear motor supporting apparatus 50. A square frame member 4 having a plurality of guide rollers 15 on both vertical sides thereof is disposed for linearly moving up and down along the vertical guide rails 7 laterally disposed in parallel to the stator 1. Inside the square frame member 4, a rotor 2 of the linear motor, having a bore hole for slidable movement of the stator 1 is disposed while maintaining a predetermined gap between an outer surface of the gator 1 and an inner surface of the bore hole of the rotor 2. A plurality of air gap adjusting rollers 3 are disposed at both upper and lower portions of the rotor 2. Here, the air gap adjusting rollers 3 are disposed for controlling any one-sided friction and preventing vibration thereof, which are caused due to the vibration of the elevator in operation. The lower end of the stator 1 is elastically connected to a yoke 23.

With a reference to FIG. 5, the linear motor supporting apparatus 50 will now be explained in detail. A lower end of the stator 1 is connected to an upper end of a spring rod 21 by a pin 22. A predetermined part of the spring rod 21 is inserted into a coil spring 24 having an upper supporting ring 24' and a lower supporting ring **27*a* thereof, which are for encasing the spring 24 inside the yoke 23. Here, the coil spring 24 receiving the spring rod 21 therewithin is encased by the hollow cylindrical yoke 23 for elastically supporting the spring rod 21. The lower portion of the yoke 23 is connected to a ball link 25 rotatably connected to a supporting bar 26 having a receiving portion at an upper end thereof for receiving the ball link 25 therein. At a lower end of the supporting bar 26 are disposed a pair of roller bearings 40 supported by the respective ends of a pin. Here, the part of the bearing 40 and the pin are encased within a hollow cylindrical rotating member 30 having an tipper cover 31 for slidably receiving the supporting bar 26 through an elongated hole 31*a* therein and a lower cover 33 for slidably receiving therein an affixing shaft 28 connected to the elevator main frame 8 of the lower supporting structure of the elevator (not shown). Here, at an upper portion of the affixing shaft 28 is disposed a flange 28*a*. A pair of thrust bearings 29 are disposed between an upper supporting member 32 and a lower supporting member 32', which are respectively rigidly mounted to the flange 28*a* and the lower cover 33 of the rotating member 30 by virtue of the roller bearings 40 and the thrust bearings 29, the rotating member 30 is rotatably engaged with the supporting bar 26 and the affixing shaft 28**, respectively.

The operational description of the linear motor supporting apparatus 50 for the linear motor elevator according to the present invention will now be explained.

First, when swinging and vibration of the car in operation of the elevator occurs, the load thereof is transferred to the stator 1 from the rotor 2 through the cable of the elevator. During the transfer of the load, vibration of the square frame member 4 is first dampened at the air gap adjusting rollers 3 disposed on the upper and lower portions of the rotor 2 of the linear elevator and transferred to the stator 1.

Among the loads transferred to the stator 1, a part of the swinging and oscillation of the vertical and horizontal loads is dampened by the coil spring 24 disposed inside the yoke 23 and the part of the swinging and oscillation load directed laterally to the left and right is dampened by the rotating member 30 slidably and rotatably coupled to both the supporting bar 26 and tile affixing shaft 28. Thus, if swinging and vibration occurs at the stator 1, tile load thereof is transferred to the supporting bar 26 through tile spring rod 21, the yoke 23 and the ball link 25. At this time, tile supporting bar 26 is freely swingingly guided along the elongated hole **31*a* because tile supporting bar 26 is slidably inserted through the elongated hole 31*a***, thereby dampening tile horizontal load thereof.

Therefore, the present invention provides an apparatus capable of diminishing and dampening the swinging and oscillation loads occurring in tile elevator in operation even in case a relative displacement is present due to the non-coincidence between the stator and the rotor in a vertical direction.

In addition, by diminishing tile load transferred to the air gap adjusting rollers due to the vibration and swinging of tile stator, tile apparatus of tile present invention can minimize the one-sided friction thereof and thus enhance the performance of the elevator operation.

What is claimed is:

1. A linear motor supporting apparatus for a linear motor elevator, comprising:

a linear motor including a rotor and a stator;

tensile force adjusting means, disposed below tile stator, for adjusting a tensile force upon the stator; and stator displacement adjusting means, disposed between the tensile force adjusting means and a supporting frame of the elevator, for reducing a load upon the stator by permitting movement of the stator to compensate for any lack of coincidence in the vertical direction between the stator and the rotor.

2. The apparatus of claim 1, wherein said tensile adjusting means includes a spring rod connected to a lower end of the stator, a yoke rigidly affixed to the spring rod and inside which a part of the spring rod is fixedly inserted, a coil spring disposed between a lower end of the spring rod and an upper surface of the yoke, and a ball link fixedly coupled to a lower portion of the yoke.

3. The apparatus of claim 1, wherein said stator displacement means includes a supporting bar rotatably connected with a ball link of the stator tensile adjustment means, an affixing shaft affixed to the supporting frame, and a rotating member disposed between the supporting bar and tile affixing shaft for rotatably connecting the supporting bar and the affixing shaft.

4. The apparatus of claim 3, wherein a lower end of said supporting bar is movably inserted into the rotating member through an elongated hole provided in an upper end of the rotating member and a plurality of bearing members are carried by the lower end of the supporting bar to bear upon the upper end of the rotating member.

5. The apparatus of claim 3, wherein said affixing shaft includes a plurality of bearings, disposed between an upper end of the affixing shaft and a lower cover of the rotating member, the affixing shaft being rotatably inserted through the lower cover of the rotating member.

* * * * *